United States Patent [19]

Richardson, Jr.

[11] Patent Number: 4,946,351

[45] Date of Patent: Aug. 7, 1990

[54] COMPRESSOR MOUNTING SYSTEM

[75] Inventor: Hubert Richardson, Jr., Brooklyn, Mich.

[73] Assignee: Tecumseh Products Company, Tecumseh, Mich.

[21] Appl. No.: 365,698

[22] Filed: Jun. 14, 1989

[51] Int. Cl.[5] ..... F04B 39/00

[52] U.S. Cl. ..... 417/363; 417/902; 248/27.3; 248/638

[58] Field of Search ..... 417/360, 363, 902; 248/638, 27.3, 635

[56] References Cited

U.S. PATENT DOCUMENTS

| | | | |
|---|---|---|---|
| 1,574,985 | 3/1926 | McWain . | |
| 1,864,150 | 6/1932 | Shields . | |
| 1,911,804 | 5/1933 | Carpenter . | |
| 1,947,501 | 2/1934 | Sharp . | |
| 2,384,410 | 9/1945 | Yates . | |
| 2,933,241 | 4/1960 | Braskamp | 417/363 X |
| 2,935,279 | 5/1960 | LaPorte et al. . | |
| 2,964,236 | 12/1960 | Kasper | 417/363 |
| 3,286,960 | 11/1966 | Douglas et al. . | |
| 3,493,201 | 2/1970 | Marran . | |
| 3,510,137 | 5/1970 | Freier . | |
| 3,790,115 | 2/1974 | Fox et al. . | |
| 4,132,194 | 1/1979 | Saito | 248/638 X |
| 4,180,231 | 12/1979 | Burnham . | |
| 4,264,282 | 4/1981 | Crago . | |
| 4,399,975 | 8/1983 | Trimarco et al. . | |
| 4,461,446 | 7/1984 | Hannibal et al. . | |
| 4,534,225 | 8/1985 | Peacock et al. | 248/632 X |
| 4,569,637 | 2/1986 | Tuckey | 417/363 X |
| 4,579,184 | 4/1986 | Hiramoto | 248/635 X |
| 4,643,386 | 2/1987 | Chastine . | |
| 4,730,994 | 3/1988 | Maertens | 417/902 X |
| 4,768,925 | 9/1988 | Geupel | 417/363 X |

FOREIGN PATENT DOCUMENTS

| | | | |
|---|---|---|---|
| 60-132080 | 7/1985 | Japan | 417/363 |
| 62-159777 | 7/1987 | Japan | 417/363 |
| 62-214282 | 9/1987 | Japan | 417/363 |
| 62-214283 | 9/1987 | Japan | 417/363 |
| 62-214284 | 9/1987 | Japan | 417/363 |

*Primary Examiner*—Leonard E. Smith
*Assistant Examiner*—Eugene L. Szczecina, Jr.
*Attorney, Agent, or Firm*—Jeffers, Hoffman & Niewyk

[57] ABSTRACT

The present invention is a vertically upright hermetic compressor for mounting to a horizontal support surface in an appliance. It comprises a housing with a bottom end, a motor compressor unit operably disposed within the housing, and a resilient boot attached to the housing bottom end to suppress noise and vibration emitted from the compressor. A mounting plate supports the boot for mounting the compressor to the horizontal support surface. The plate receives the boot in a central aperture and has grommets for spacing the boot above the surface and attaching it to the horizontal support surface.

16 Claims, 1 Drawing Sheet

COMPRESSOR MOUNTING SYSTEM

BACKGROUND OF THE INVENTION

The field of the invention is that of hermetic compressors installed in appliances such as refrigerators, freezers, air conditioners, dehumidifiers, and the like. More particularly, the field is that of apparatus for mounting a compressor to an appliance frame, enclosure, or cabinet.

Hermetic compressors comprise a motor-compressor unit disposed within a hermetically sealed outer housing. An electrical connection is made via a terminal which extends through a sidewall of the housing, while fluid conduits extend through the sidewall to provide an external connection for the refrigerant fluids. The hermetic compressor is easily incorporated into an appliance by mounting the compressor to the appliance cabinet and making the appropriate electrical and fluid connections. However, compressors generate undesired noise and vibration which can only be reduced by mounting the compressor in a manner which suppresses the undesired noise and vibrations.

Various structures are used to mount a hermetic rotary compressor in an appliance cabinet, typically upon a horizontal surface in an upright position. One structure has a base plate welded to the bottom of the compressor housing, with the base plate having a plurality of holes that have grommets forcibly fit into them. The grommets have apertures with sleeves through which a nut and bolt assembly is received to secure the compressor and plate to the appliance. Another structure involves welding, to the bottom of the compressor housing, a plurality of support legs which are shaped and positioned to be placed upon posts which are interposed between the legs and the horizontal support surface, the posts having a pad or other resilient material to absorb noise and vibration.

The previously mentioned structures require the mounting apparatus to be welded onto the compressor housing. Welding increases the manufacturing cost and subjects the housing to heat which may result in undesired deformation of the housing. Additionally, the extra components (the plate and legs) increase the complexity, hence the chance of error, of assembly.

Another type of structure involves supporting the compressor on a resilient material which separates the compressor from the horizontal support surface. One such structure comprises a plurality of hollow spring cylinders which engage locations on the bottom of the compressor housing, with the compressor resting on the springs. However, this structure requires that the compressor be supported at its top end to insure a vertical stability, typically by welding a mounting stud to the compressor housing and providing additional support structure on the appliance cabinet.

Another prior art mounting structure is disclosed in U.S. Pat. No. 4,461,446 (Hannibal). A plurality of indentations are located on the underside of the compressor housing for receiving grommets. The grommets may be of resilient material so that barbs or other projections on the base surface become embedded in the grommets when the compressor is lowered onto the surface. Although an improvement over previous devices, the Hannibal mounting device still requires additional manufacturing steps to make the projections, to place the grommets on the projections, and to position the compressor so the grommets are within the indentations.

Also, this device requires a modification of the compressor housing design to accommodate the indentations.

While these prior art structures serve to attach a compressor to an appliance cabinet, problems exist. The compressor imparts undesired vibration to the supporting base as well as causing noise to radiate from the compressor housing. The noise and vibration are readily transmitted from the compressor mechanism by an end plate which typically forms one end of the compressor housing. These problems are particularly pronounced with compressors having an end plate adjacent to the cylinder block of a rotary vane compressor mechanism because noise tends to radiate from the end plate.

Thus, what is needed is a mounting structure for attaching a compressor to a horizontal support surface in a vertical position with minimal additional structure on the compressor housing and appliance cabinet, so that vibration and noise radiating from the compressor housing are suppressed.

SUMMARY OF THE INVENTION

The present invention provides a mounting apparatus for mounting a hermetic compressor to a horizontal support surface in an upright position. A resilient boot engages the bottom end of the compressor to substantially cover it thus isolating the compressor's vibration and suppressing noise radiating from the bottom end of the housing.

The resilient boot receives the bottom end of the compressor and resiliently captures a flange of the compressor. The upper rim of the boot extends over the flange as the lower portion of the side wall and base form a chamber below the compressor bottom end. The boot is supported on an inner ring of a plate, with the inner ring positioned in an outer annular groove of the boot. The shape and size of the boot can be varied for different compressors and different space restrictions of appliance cabinets. The contour of the boot and plate vertically position the compressor and hold it so that vibration is absorbed and noise is insulated from the horizontal support surface.

The mounting plate has holes for receiving a plurality of grommets, the grommets receiving bolts to attach the plate to the horizontal support surface. The grommets raise the plane of the plate to a height sufficient to keep the base of the boot from resting on the support surface. The number and configuration of the holes can be varied for the appliance cabinet to be used, while the shape of the inner ring can be varied for different shapes and diameters of boots. Also, the height of the grommets can be varied for different boot heights and shapes.

The present invention is, in one aspect, a vertically upright hermetic compressor for mounting to a horizontal support surface. It comprises a housing with a bottom end, a motor compressor unit operably disposed within the housing, and a resilient boot attached to the bottom end. An inner annular groove of the boot substantially covers the bottom end and vertically supports the housing. A mounting device is removably attached to the boot, for mounting the compressor to the horizontal support surface.

In accordance with another aspect of the present invention, the mounting apparatus comprises a plate with securing components for attaching to the horizontal support surface and a resilient body member disposed within the plate. The body member is supported by the plate and has a receptacle for receiving a bottom portion of the compressor. The receptacle includes an opening shaped to receive the compressor, a sidewall having an annular rim with an inner circumference less than the outer circumference of the compressor bottom portion to frictionally engage the compressor, and an inner annular groove below the rim for receiving the outer circumference of the compressor.

An advantage of the present invention is that a compressor may be mounted to a support base without the need for hardware welded to the outside of the compressor housing. Another advantage of the present invention is that sound radiating from the bottom the compressor housing is suppressed. A further advantage of the mounting boot of the present invention is that the suppression of vibration and sound from a compressor mounted within an appliance cabinet is simply and economically achieved. Still another advantage of the mounting boot of the present invention is that the frictional engagement of the boot with the compressor housing is maintained despite vibratory and shock forces that might otherwise cause disengagement. An additional advantage of the present invention is that the mounting of a compressor to a support base is accomplished by attaching the compressor to a single part, i.e. a resilient body member, thereby simplifying installation. Also, an advantage is found in the present invention's versatility in mounting because the plate carries the mounting grommets.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
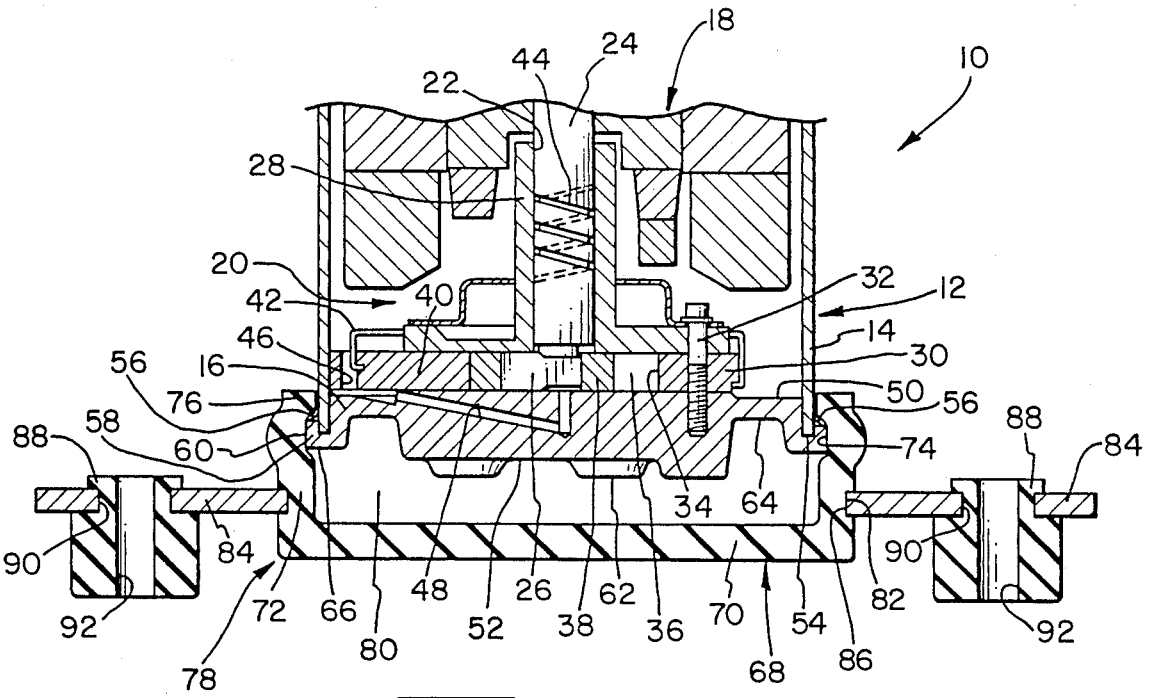
FIG. 1 is a side sectional view of the hermetic compressor and mounting apparatus of the present invention.

Corresponding reference characters indicate corresponding parts throughout the several views. The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

In the embodiment of the present invention as shown in the drawings, and in particular in FIG. 1, a vertical axis hermetic rotary compressor 10 is shown having a housing 12 which comprises a generally cylindrical central portion 14 and a bottom end plate 16. The housing components are hermetically secured together by welding or brazing. Disposed within housing 12 is a motor compressor unit comprising an electric motor 18 (only partially shown) and a rotary vane compressor mechanism 20. Motor 18 comprises a rotor and a stator which has windings.

The rotor of motor 18 has a central aperture 22, within which a rotatable crankshaft 24 is secured by an interference fit, e.g. shrink fitting. Crankshaft 24 includes an eccentric portion 26 drivingly connected to compressor mechanism 20, which compresses refrigerant for discharge into the interior of housing 12. A refrigerant discharge tube is sealingly connected to top portion of housing 12, e.g. by soldering. Similarly, a hermetic electric terminal is also secured to the top portion, so a connector can connect the terminal to the interior of housing 12 for supplying electric power to motor 20.

Compressor mechanism 20 of FIG. 1 is a rotary vane compressor mechanism similar to the device described in U.S. Pat. No. 4,730,994, which is hereby incorporated by reference. Only a brief description is provided here to aid in the understanding of the present invention. Compressor mechanism 22 includes a main bearing 28 in which crankshaft 24 is rotatably journalled, end plate 16, and a compressor cylinder block 30 disposed between main bearing 28 and end plate 16. As shown in FIG. 1, end plate 16 is secured to main bearing 28 by means of a plurality of bolts 32.

Cylinder block 30 defines an axial bore 34; main bearing 28, end plate 16, and bore 34 define a compression chamber 36. A roller 38 surrounds crankshaft eccentric 26 in compression chamber 36, and cooperates with a sliding vane 40 for compressing a refrigerant fluid in compression chamber 36 in a known manner. Additionally, a vane spring 42 provides a biasing force to the back of sliding vane 40. Compressor mechanism 20 also includes a lubrication system similar to that described in U.S. Pat. No. 4,730,994, incorporated herein by reference, including helical passageways 44 formed in crankshaft 24, axial passageway 46 formed in cylinder block 30, and radial passageway 48 formed in end plate 16.

End plate 16 is a part of compressor mechanism 20 and serves as the bottom portion of housing 12. It is a circularly shaped plate having a top surface 50 and a bottom surface 52. At its periphery, an annular recess 54 is formed in top surface 50 which receives central portion 14, with weldment 56 securing portion 14 to plate 16. End plate 16 also includes a flange portion 58 having a greater diameter than central portion 14, extending radially outward to the outer circumference of flange 58 which defines facing surface 60. The bottom surface 52 of end plate 16 comprises a middle circular surface 62 which is surrounded by an annular groove 64, which is circumferentially bordered by an outer annular support edge 66. The plane defined by outer annular support edge 66 is located between the planes defined by surface 62 and groove 64.

The present invention comprises mounting the compressor 10 upon a mounting boot 68, as shown in FIG. 1, to mount compressor 10 in an upright position on a horizontal support surface (not shown). The particular shape of the preferred embodiment is for use with a particular rotary compressor configuration, although the mounting boot of the present invention can be adapted for use with other shapes using the teachings of this disclosure. Mounting boot 68 is a unitary piece molded from Santoprene thermoplastic rubber material available from Monsanto Corporation of St. Louis, Mo. However, any other suitable resilient, flexible material may be used.

Boot 68 is cup-shaped having a base 70 and a cylindrical sidewall 72. On the inner surface of sidewall 72 near its top, a inner annular depression or portion 74 is located; above annular depression 74 at the top of sidewall 72 is annular rim 76. Most of sidewall 72, including rim 76 but excepting depression 74, has a diameter approximately equal to the diameter of central portion 14, both diameter being less than the diameter of the circle defined by flange portion 58. Depression 74 is caused when boot 68 necks down on flange 58, otherwise portion 74 has a diameter approximately equal to the rest of sidewall 72. Alternately, a groove may be formed in sidewall 72 at portion 74 shaped to receive flange 58.

To place the compressor 10 within boot 68, compressor 10 is positioned within cup 78, and then boot 68 is either pressed, stretched, or shrunk into flange 58 of end plate 16. When compressor 10 is placed within boot 68, flange 58 snap fits within annular portion 74 as annular rim 76 abuts central portion 14 of housing 12. The inner surfaces of boot 68 and lower surface 52 of end plate 16 define a boot chamber 80 which provides an additional buffer zone for noise emitting from housing 12 through plate 16. The combination of portion 74 and rim 76 interacting with flange 58 serves to hold housing 12 within boot 68, thus vertically retaining compressor 10.

Figure 2:
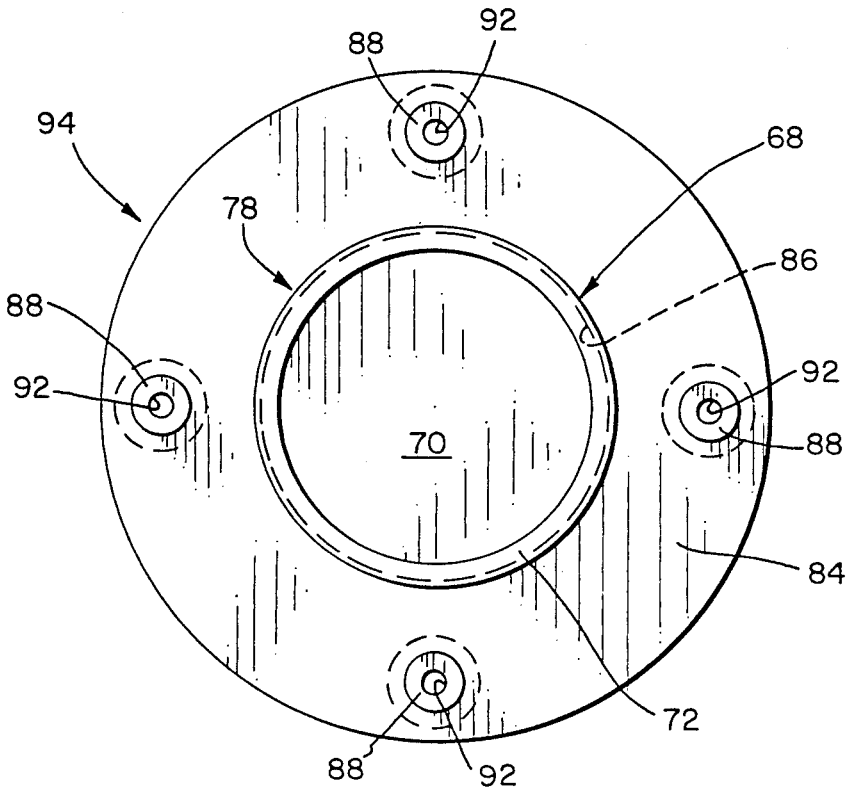
FIG. 2 is a top plan view of the mounting apparatus.

On the outer side of sidewall 72, outer annular groove 82 receives a portion of plate 84; specifically, groove 82 is shaped to receive a circular inner edge 86 of plate 84. Boot 68 is supported by plate 84 solely at outer groove 82, and is connected to plate 84, at its inner opening defined by edge 86, by a resilient snap fit. Plate 84 is connected to a horizontal support surface by a plurality of grommets 88 which reside in bores 90 of plate 84. Grommets 88 have centrally located mounting holes 92 which accommodate bolts that secure mounting device 94 (see FIG. 2) to a horizontal support surface within an appliance cabinet (not shown). The grommets 88 raise base 70 above the horizontal support surface. Thus, compressor 10 is supported by boot 68, which suppresses and isolates noise and vibration, and boot 68 is supported by plate 82, which secures mounting device 94 to an appliance cabinet in a vertically upright position.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A vertically upright hermetic compressor assembly for mounting to a horizontal support surface, comprising:

a housing including a bottom end;

a motor compressor unit operably disposed within said housing;

a resilient boot attached to said bottom end by a sidewall for substantially covering said bottom end and vertically supporting said housing, said boot including a base having said sidewall circumferentially, upwardly extending from said base, said sidewall having an upper rim located above an inner portion, said inner portion receiving said housing bottom end, and said rim having an inner circumference extending towards a central portion of said housing such that said housing bottom end is frictionally secured within said boot;

a plate having an aperture in which said boot is received to support said boot; and mounting means, removably attached to said plate, for mounting said compressor and said boot to a horizontal support surface.

2. The compressor assembly of claim 1 wherein said housing includes a generally cylindrical central portion and a bottom portion having an outwardly extending circumferential flange, said flange located within said boot.

3. The compressor assembly of claim 1 including an outer groove in said boot sidewall in which an edge of the plate aperture is received.

4. The compressor assembly of claim 1 wherein said plate includes a plurality of bores located circumferentially about said aperture, said bores containing resilient grommets to attach said plate to a horizontal support surface such that said boot is spaced above the horizontal support surface.

5. The compressor assembly of claim 1 wherein said housing bottom end includes an outwardly extending circumferential flange, the inner circumference of said boot is less than the outer circumference of said housing flange, the outer circumference of said housing flange is less than the circumference of said plate aperture, and the circumference of said plate aperture is less than the outer circumference of said boot.

6. A mounting apparatus for mounting a hermetic compressor to a horizontal support surface in a vertically upright manner, comprising:

a plate having a securing means for attaching said plate to a horizontal support surface and including an aperture having an edge; and a resilient body member disposed within said plate such that said body member is supported by said plate, said body member including a receptacle means for receiving a bottom portion of the compressor wherein said receptacle means comprises an opening shaped to receive the compressor, a sidewall having an annular rim with an inner circumference less than the outer circumference of the compressor to frictionally engage the compressor, an external groove in which the edge of said aperture is received, and a base.

7. The mounting apparatus of claim 6 wherein said securing means includes a plurality of bores located circumferentially on said plate about said body member, said bores containing grommets to attach said plate to a horizontal support surface using bolts such that said base is spaced above the horizontal support surface.

8. The mounting apparatus of claim 6 wherein said body member is comprised of materials including thermoplastic rubber.

9. A vertically upright hermetic compressor assembly for mounting to a horizontal support surface, comprising:

an outer housing having operably disposed therein a motor compressor unit, said housing including a generally cylindrical central portion, a bottom end, and a radially outwardly extending housing flange portion adjacent said bottom end;

a resilient cup-shaped boot including a resilient upwardly extending wall portion having a generally cylindrical inner wall within which said flange portion is frictionally engaged, said inner wall having a diameter less than the diameter of said flange portion such that said wall portion is resiliently biased against said flange portion; and mounting means for mounting said compressor to the horizontal support surface in a vertically upright manner, said mounting means comprising a means engaging an outer sidewall of said boot for supporting said boot and a securing means to attach said mounting means to the horizontal support surface.

10. The compressor assembly of claim 9 wherein said boot includes a base having said wall portion circumferentially, upwardly extending from said base, said wall including an upper rim located above an inner portion, said inner portion having an annular depression therein receiving said housing flange and said rim extending over said flange such that said flange is frictionally secured within said boot.

11. The compressor assembly of claim 9 wherein said mounting means includes a plate having a central aperture, said central aperture receiving said boot.

12. The compressor assembly of claim 11 wherein said securing means includes a plurality of bores located circumferentially about said central aperture, said bores containing grommets for receiving bolts to attach said plate to the horizontal support surface such that said boot is spaced above the horizontal support surface.

13. A mounting boot for mounting a hermetic compressor to a horizontal support surface, wherein the compressor includes a housing having a bottom end, and a generally cylindrical central portion, said boot comprising:

a plate having mounting means for attaching to the horizontal support surface, said plate having a central opening; and a resilient cup-shaped body member comprising a planar base portion, an annular upstanding sidewall portion having an outer groove shaped to fit said opening for attaching said body member to said plate, and said annular upstanding sidewall portion having an inwardly facing surface adapted to circumferentially frictionally engage the compressor central portion to cover substantially all of the compressor bottom end.

14. The mounting boot of claim 13 wherein said plate includes a plurality of bores located circumferentially about said central aperture, said bores containing grommets, said grommets adapted for receiving bolts to attach said plate to the horizontal support surface such that said base is spaced above the horizontal support surface.

15. The mounting boot of claim 13 wherein said inwardly facing surface of said sidewall portion has a circumference less than the circumference of the outermost periphery of the compressor.

16. The mounting boot of claim 13 wherein said body member is comprised of thermoplastic rubber.

* * * * *